US007876300B2

(12) United States Patent
Baik et al.

(10) Patent No.: US 7,876,300 B2
(45) **Date of Patent: *Jan. 25, 2011**

(54) METHOD AND APPARATUS FOR DRIVING LIQUID CRYSTAL DISPLAY

(75) Inventors: Seong Ho Baik, Gwacheon-shi (KR); Chul Sang Jang, Sungnam-shi (KR)

(73) Assignee: LG Display Co., Ltd., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/721,276

(22) Filed: Mar. 10, 2010

(65) Prior Publication Data

US 2010/0165010 A1 Jul. 1, 2010

Related U.S. Application Data

(62) Division of application No. 10/879,947, filed on Jun. 28, 2004, now Pat. No. 7,705,814.

(30) Foreign Application Priority Data

Nov. 17, 2003 (KR) ..... 10-2003-81172

(51) Int. Cl.
*G09G 3/36* (2006.01)

(52) U.S. Cl. ..... 345/88; 345/98

(58) Field of Classification Search ..... 345/87–89, 345/98–100, 102, 600–604; 348/671–672
See application file for complete search history.

(56) References Cited

U.S. PATENT DOCUMENTS

| | | | | |
|---|---|---|---|---|
| 7,339,565 | B2 | 3/2008 | Kim | |
| 7,522,135 | B2 | 4/2009 | Baik | |
| 7,705,814 | B2 * | 4/2010 | Baik et al. | 345/88 |
| 2005/0001801 | A1 | 1/2005 | Kim | |
| 2005/0140640 | A1 | 6/2005 | Oh et al. | |

* cited by examiner

*Primary Examiner*—Ricardo L Osorio
(74) *Attorney, Agent, or Firm*—Brinks Hofer Gilson & Lione

(57) ABSTRACT

A driving method and apparatus for a liquid crystal display uses a comparison between the previous frame and the current frame to expand the contrast ratio and reduce the manufacturing cost. A limited amount of data from the current image may be used: either using a limited area of the image or merely the amount of green in the overall image or the limited area. In the apparatus, an image signal modulator expands the contrast of the input data when the previous image is analogous to the current image to thereby generate output data. A timing controller re-arranges the output data to apply the output data to a data driver.

9 Claims, 17 Drawing Sheets

METHOD AND APPARATUS FOR DRIVING LIQUID CRYSTAL DISPLAY

The present patent document is a divisional of U.S. patent application Ser. No. 10/879,947, filed Jun. 28, 2004, which claims priority of the Korean Patent Application No. P2003-81172 filed on Nov. 17, 2003, which is hereby incorporated by reference.

BACKGROUND OF THE INVENTION

1. Field of the Invention

This invention relates to a liquid crystal display, and more particularly to a driving method and apparatus for a liquid crystal display in which a result of the previous frame is applied to the current frame, thereby expanding the contrast ratio and reducing the manufacturing cost of the liquid crystal display.

2. Description of the Related Art

Generally, a liquid crystal display (LCD) controls light transmittance of liquid crystal cells in accordance with video signals to thereby display a picture. Such an LCD has been implemented by an active matrix type having a switching device for each cell, and applied to a display device such as a monitor for a computer, office equipments, a cellular phone and the like. The switching device for the active matrix LCD mainly employs a thin film transistor (TFT).

FIG. 1 schematically shows a conventional LCD driving apparatus.

Referring to FIG. 1, the conventional LCD driving apparatus includes a liquid crystal display panel 2 having m×n liquid crystal cells Clc arranged in a matrix type, m data lines D1 to Dm and n gate lines G1 to Gn intersecting each other and thin film transistors TFT provided at the intersections, a data driver 4 for applying data signals to the data lines D1 to Dm of the liquid crystal display panel 2, a gate driver 6 for applying scanning signals to the gate lines G1 to Gn, a gamma voltage supplier 8 for supplying the data driver 4 with gamma voltages, a timing controller 10 for controlling the data driver 4 and the gate driver 6 using synchronizing signals from a system 20, a direct current to direct current converter 14, hereinafter referred to as "DC/DC converter", for generating voltages supplied to the liquid crystal display panel 2 using a voltage from a power supply 12, and an inverter 16 for driving a back light 18.

The system 20 applies vertical/horizontal signals Vsync and Hsync, clock signals DCLK, a data enable signal DE and data R, G and B to the timing controller 10.

The liquid crystal display panel 2 includes a plurality of liquid crystal cells Clc arranged, in a matrix type, at the intersections between the data lines D1 to Dm and the gate lines G1 to Gn. The thin film transistor TFT provided at each liquid crystal cell Clc applies a data signal from each data line D1 to Dm to the liquid crystal cell Clc in response to a scanning signal from the gate line G. Further, each liquid crystal cell Clc is provided with a storage capacitor Cst. The storage capacitor Cst is provided between a pixel electrode of the liquid crystal cell Clc and a pre-stage gate line or between the pixel electrode of the liquid crystal cell Clc and a common electrode line, to thereby constantly keep a voltage of the liquid crystal cell Clc.

The gamma voltage supplier 8 applies a plurality of gamma voltages to the data driver 4.

The data driver 4 converts digital video data R, G and B into analog gamma voltages (i.e., data signals) corresponding to gray level values in response to a control signal CS from the timing controller 10, and applies the analog gamma voltages to the data lines D1 to Dm.

The gate driver 6 sequentially applies a scanning pulse to the gate lines G1 to Gn in response to a control signal CS from the timing controller 10 to thereby select horizontal lines of the liquid crystal display panel 2 supplied with the data signals.

The timing controller 10 generates the control signals CS for controlling the gate driver 6 and the data driver 4 using the vertical/horizontal synchronizing signals Vsync and Hsync and the clock signal DCLK inputted from the system 20. Herein, the control signal CS for controlling the gate driver 6 is comprised of a gate start pulse GSP, a gate shift clock GSC and a gate output enable signal GOE, etc. Further, the control signal CS for controlling the data driver 4 is comprised of a source start pulse SSP, a source shift clock SSC, a source output enable signal SOE and a polarity signal POL, etc. The timing controller 10 re-aligns the data R, G and B from the system 20 to apply them to the data driver 4.

The DC/DC converter 14 boosts or drops a voltage of 3.3V inputted from the power supply 12 to generate a voltage supplied to the liquid crystal display panel 2. Such a DC/DC converter 14 generates a gamma reference voltage, a gate high voltage VGH, a gate low voltage VGL and a common voltage Vcom.

The inverter 16 applies a driving voltage (or driving current) for driving the back light 18 to the back light 18. The back light 18 generates a light corresponding to the driving voltage (or driving current) from the inverter 16 to apply it to the liquid crystal display panel 2.

In order to display a vivid image on the liquid crystal display panel 2 driven in this manner, a distinct contrast between brightness and darkness must be made in correspondence with data to be used to produce the image. However, since the conventional back light 18 produces a constant brightness irrespectively of this data, it is difficult to display a dynamic and fresh image.

SUMMARY OF THE INVENTION

A driving method and apparatus for a liquid crystal display are provided in which a result of the previous frame is applied to the current frame, thereby expanding the contrast ratio of the current frame and reducing the manufacturing cost of the liquid crystal display.

A driving apparatus for a liquid crystal display according to one aspect of the present invention includes an image signal modulator for expanding contrast of input data when it is determined that a previous image is analogous to the current image to thereby generate output data. A timing controller re-arranges the output data to apply the output data to a data driver.

The driving apparatus further includes a controller for changing a synchronizing signal inputted in synchronization with the input data to be synchronized with the output data.

When it is determined that the previous image is analogous to the current image, the current image is converted using a result of the previous frame to thereby generate the output data.

The image signal modulator includes a brightness/color separator for converting input data corresponding to the current frame into brightness components and chrominance components; a histogram analyzer for arranging the brightness components into a histogram for each frame and for storing a histogram corresponding to the previous frame; an image analyzer for extracting a control value from partial area brightness components of the brightness components for the current frame; a comparator for determining analogy between the current image and the previous image using the control value from the current frame partial area brightness components and a previous frame partial area control value; and a data processor for modulating the brightness components of the current frame to have an expanded contrast ratio in correspondence with a result of the comparator to thereby generate modulated brightness components.

The control value is the most-frequent value (the most numerous gray level in the histogram) and an average value (the average value of the histogram gray levels).

The histogram analyzer generates a histogram using brightness components of an ith frame (wherein i is an integer) corresponding to the current frame supplied from the brightness/color separator, and applies a histogram of an (i−1)th frame stored therein to the data processor.

The image analyzer includes an area extractor for extracting partial area brightness components of the current brightness components; an area histogram analyzer for dividing the extracted partial area brightness components into gray levels to generate a histogram; and a control value extractor for extracting the current frame partial area control value from the image histogram analyzer.

Herein, the comparator includes a first register for storing the current frame partial area control value; a second register for storing the previous frame partial area control value; and a determiner for determining an analogy between the current image and the previous image using the current frame partial area control value and the previous frame partial area control value stored in the first and second registers.

The determiner determines that the current image is analogous to the previous image when the current frame partial area control value exists within a specific deviation from the previous frame partial area control value, whereas it determines that the current image is not analogous to the previous image in the other case.

The data processor includes an image processor for generating the modulated brightness components; and a selector for outputting the modulated brightness components or the non-modulated brightness components.

The selector outputs the modulated brightness components when the comparator determines that the current image is analogous to the previous image, whereas it outputs the non-modulated brightness components in the other case.

The driving apparatus further includes delay means for delaying the chrominance components and the brightness components during a time interval when the comparator determines the analogy between the current image and the previous image using the current frame partial area control value; and a brightness/color mixer for generating the output data using the brightness components or the modulated brightness components and the chrominance components of the current frame supplied from the data processor.

The driving apparatus further includes back light control means for controlling brightness of a back light in response to a result of the comparator.

Herein, the back light control means includes a control value extractor for extracting a control value for a previous histogram when the comparator determines that the current image is analogous to the previous image; and a back light controller for controlling the brightness of the back light in correspondence with the extracted control value from the control value extractor.

The control value extractor dose not extract the control value when the comparator determines that the current image is analogous to the previous image, and the back light controller controls the back light such that light of a predetermined brightness can be supplied when the control value is not applied from the control value extractor.

The image signal modulator includes a histogram analyzer for arranging green input data corresponding to the current frame into gray levels for each frame to generate a histogram and for storing the generated histogram using green data of the previous frame; an image analyzer for extracting a control value from green data in a partial area of the current frame; a comparator for determining the analogy between the current image and the previous image using the current partial area control value and the previous partial area control value; and a data processor for generating the output data obtained by an expansion in a contrast of the input data in correspondence with a result of the comparator.

Herein, the data processor includes an image processor for generating the output data having an expanded contrast; and a selector for applying the output data or the input data to the timing controller.

The selector applies the output data to the timing controller when the comparator determines that the current image is analogous to the previous image, whereas it applies the input data to the timing controller in the other case.

The driving apparatus further includes delay means for delaying the input data during a time interval when the comparator determines the analogy between the current image and the previous image.

The driving apparatus further includes back light control means for controlling brightness of a back light in response to a result of the comparator.

The back light control means includes a control value extractor for extracting a control value of the previous histogram when the comparator determines that the current image is analogous to the previous image; and a back light controller for controlling the brightness of the back light in correspondence with the extracted control value from the control value extractor.

The control value extractor dose not extract the control value when the comparator determines that the current image is analogous to the previous image, and the back light controller controls the back light such that a predetermined brightness of light can be supplied when the control value is not applied from the control value extractor.

A method of driving a liquid crystal display according to another aspect of the present invention includes determining an analogy between the previous image and the current image; and converting input data of the current frame to have an expanded contrast using a result of the previous frame when the previous image is analogous to the current image.

In the method, the input data of the current frame is not converted when the previous image is not analogous to the current image.

Determining the analogy includes converting currently inputted data of the current frame into brightness components and chrominance components; arranging partial area brightness components of the brightness components for one frame into a histogram corresponding to gray levels; extracting a control value from the histogram; and determining that the previous image is analogous to the current image when the extracted control value exists within a specific deviation from a control value extracted from the previous frame.

Converting the input data of the current frame includes converting the input data using a histogram generated from the brightness components of the previous frame.

Determining the analogy includes arranging green data in a partial area of data for one frame into a histogram corresponding to gray levels; extracting a control value from the histogram; and determining that the previous image is analogous to the current image when the extracted control value exists within a specific deviation from a control value extracted from the previous frame.

Converting an input data of the current frame includes converting the input data using a histogram generated from the green data of the previous frame.

The method further includes controlling brightness of the back light when the previous image is analogous to the current image.

BRIEF DESCRIPTION OF THE DRAWINGS

Embodiments of the invention will be apparent from the following detailed description of the embodiments of the present invention with reference to the accompanying drawings, in which.

DETAILED DESCRIPTION OF THE PREFERRED EMBODIMENT

Figure 1:
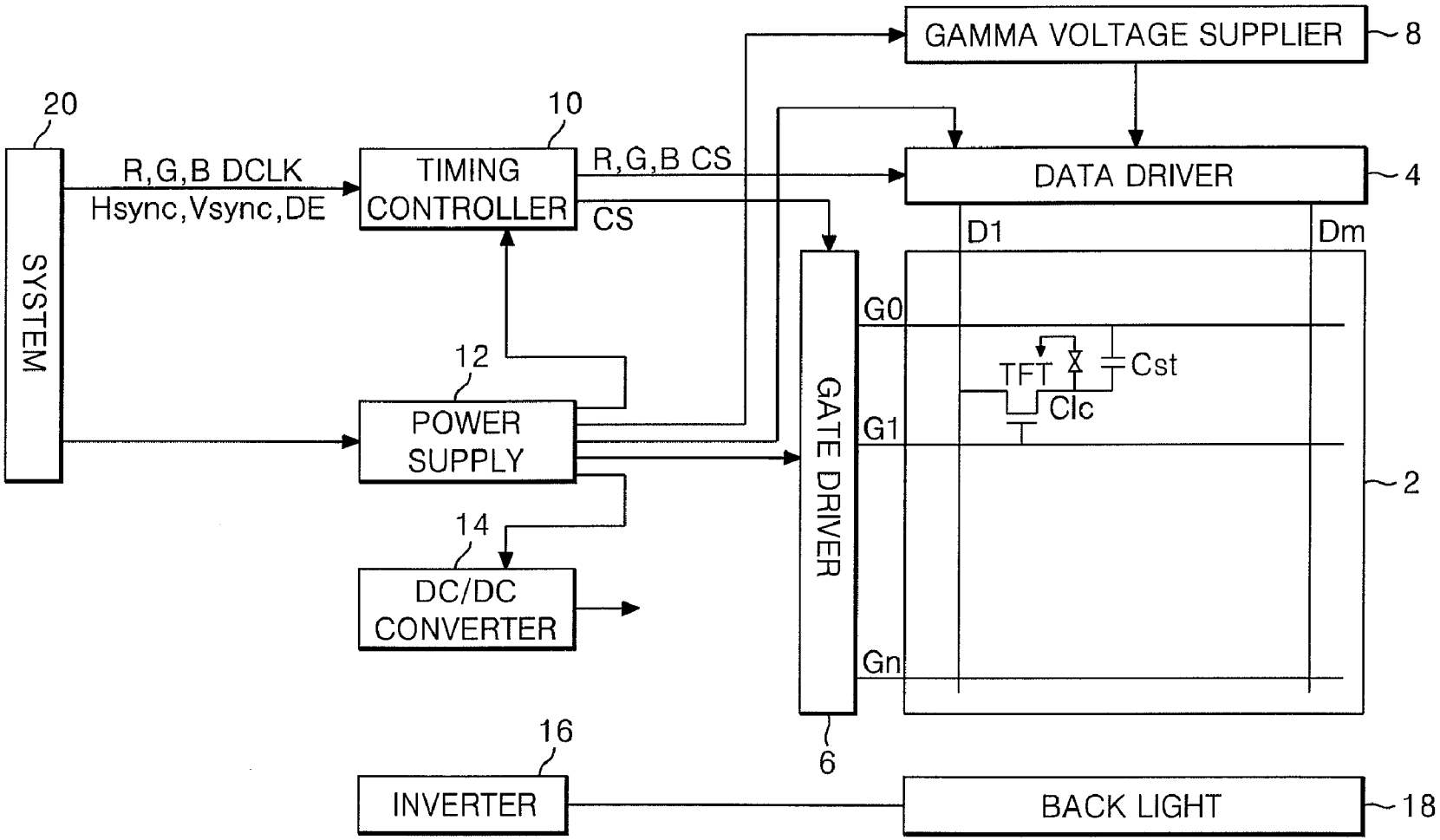
FIG. 1 RELATED ART
FIG. 1 is a schematic block diagram showing a configuration of a conventional driving apparatus for a liquid crystal display.
Figure 2:
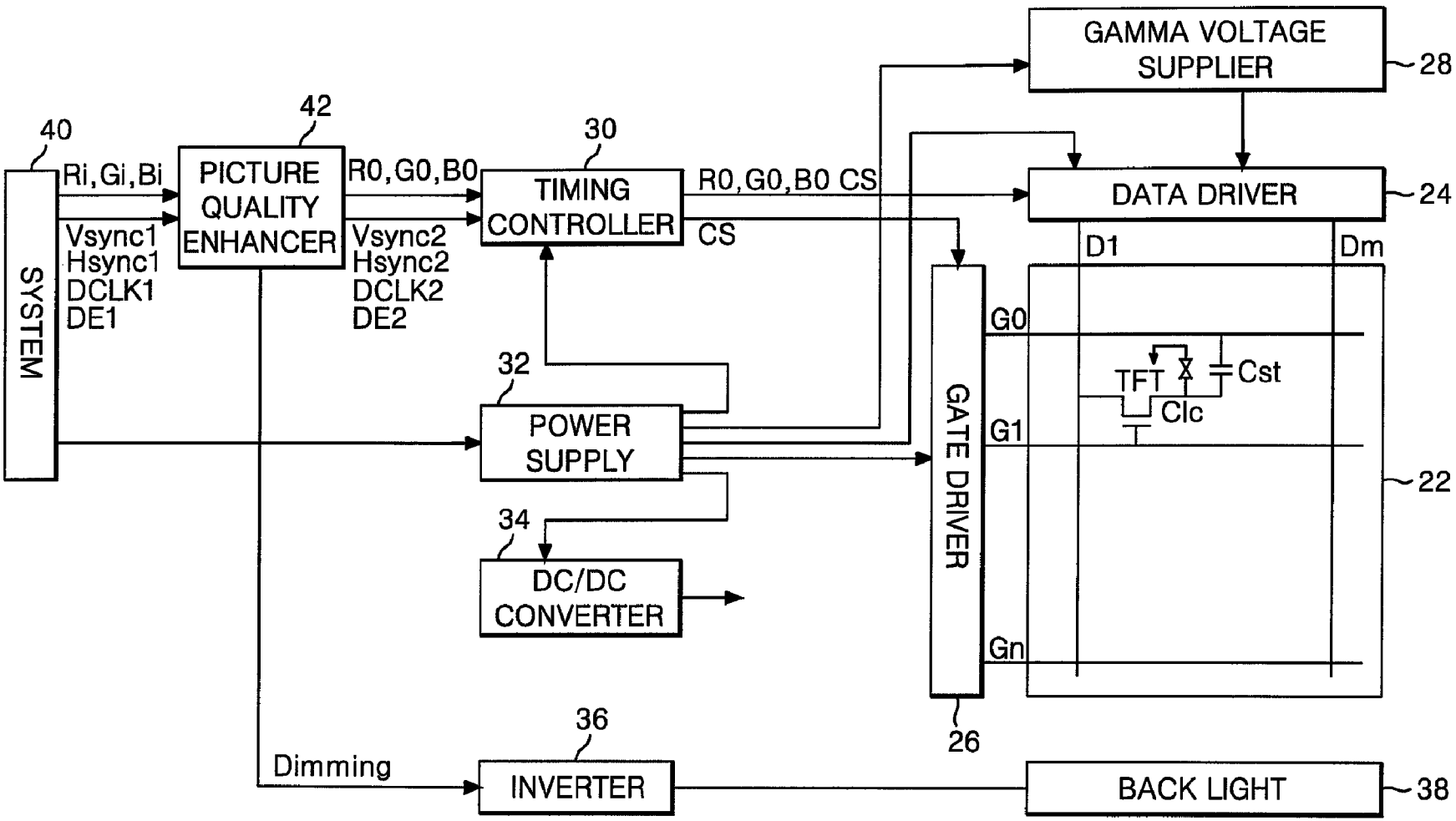
FIG. 2 is a schematic block diagram showing a configuration of a driving apparatus for a liquid crystal display according to an embodiment of the present invention.

FIG. 2 schematically shows a driving apparatus for a liquid crystal display (LCD) according to a first embodiment of the present invention.

Referring to FIG. 2, the LCD driving apparatus according to the embodiment of the present invention includes a liquid crystal display panel 22 having m×n liquid crystal cells Clc arranged in a matrix type, m data lines D1 to Dm and n gate lines G1 to Gn intersecting each other and thin film transistors TFT provided at the intersections, a data driver 24 for applying data signals to the data lines D1 to Dm of the liquid crystal display panel 22, a gate driver 26 for applying scanning signals to the gate lines G1 to Gn, a gamma voltage supplier 28 for supplying the data driver 24 with gamma voltages, a timing controller 30 for controlling the data driver 24 and the gate driver 26 using a second synchronizing signal from a picture quality enhancer 42, a DC/DC converter for generating voltages supplied to the liquid crystal display panel 22 using a voltage from a power supply 32, an inverter 36 for driving a back light unit 38, and a picture quality enhancer 42 for selectively emphasizing a contrast of an input data and for applying a brightness control signal Dimming corresponding to the input data to the inverter 36.

The system 40 applies first vertical/horizontal signals Vsync1 and Hsync1, a first clock signal DCLK1, a first data enable signal DE1 and first data Ri, Gi and Bi to the picture quality enhancer 42.

The liquid crystal display panel 22 includes a plurality of liquid crystal cells Clc arranged, in a matrix type, at the intersections between the data lines D1 to Dm and the gate lines G1 to Gn. The thin film transistor TFT provided at each liquid crystal cell Clc applies a data signal from each data line D1 to Dm to the liquid crystal cell Clc in response to a scanning signal from the gate line G. Further, each liquid crystal cell Clc is provided with a storage capacitor Cst. The storage capacitor Cst is provided between a pixel electrode of the liquid crystal cell Clc and a pre-stage gate line or between the pixel electrode of the liquid crystal cell Clc and a common electrode line, to thereby constantly keep a voltage of the liquid crystal cell Clc.

The gamma voltage supplier 28 applies a plurality of gamma voltages to the data driver 24.

The data driver 24 converts digital video data R, G and B into analog gamma voltages (i.e., data signals) corresponding to gray level values in response to a control signal CS from the timing controller 30, and applies the analog gamma voltages to the data lines D1 to Dm.

The gate driver 26 sequentially applies a scanning pulse to the gate lines Gi to Gn in response to a control signal CS from the timing controller 30 to thereby select horizontal lines of the liquid crystal display panel 22 supplied with the data signals.

The timing controller 30 generates the control signals CS for controlling the gate driver 26 and the data driver 24 using second vertical/horizontal synchronizing signals Vsync2 and Hsync2 and a second clock signal DCLK2 inputted from the picture quality enhancer 42. Herein, the control signal CS for controlling the gate driver 26 is comprised of a gate start pulse GSP, a gate shift clock GSC and a gate output enable signal GOE, etc. Further, the control signal CS for controlling the data driver 24 is comprised of a source start pulse SSP, a source shift clock SSC, a source output enable signal SOE and a polarity signal POL, etc. The timing controller 30 re-aligns second data Ro, Go and Bo from the picture quality enhancer 42 to apply them to the data driver 24.

The DC/DC converter 34 boosts or drops a voltage of 3.3V inputted from the power supply 32 to generate a voltage supplied to the liquid crystal display panel 22. Such a DC/DC converter 14 generates a gamma reference voltage, a gate high voltage VGH, a gate low voltage VGL and a common voltage Vcom.

The inverter 36 applies a driving voltage (or driving current) corresponding to the brightness control signal Dimming from the picture quality enhancer 42 to the back light 38. In other words, a driving voltage (or driving current) applied from the inverter 36 to the back light 38 is determined by the brightness control signal Dimming from the picture quality enhancer 42. The back light 38 applies light corresponding to the driving voltage (or driving current) from the inverter 36 to the liquid crystal display panel 22.

The picture quality enhancer 42 extracts brightness components using the first data Ri, Gi and Bi from the system 40, and generates second data Ro, Go and Bo obtained by a change in gray level values of the first data Ri, Gi and Bi in correspondence with the extracted brightness components. In this case, the picture quality enhancer 42 generates the second data Ro, Go and Bo such that a contrast is selectively expanded with respect to the input data Ri, Gi and Bi.

Further, the picture quality enhancer 42 generates a brightness control signal Dimming corresponding to brightness components to apply it to the inverter 36. The picture quality enhancer 42 extracts a control value capable of controlling the back light (i.e., most frequent value, that is, the most numerous gray level value in the frame) and/or an average value (i.e., the average value of the gray levels in the frame) from the brightness components, and generates the brightness control signal Dimming using the extracted control value. The picture quality enhancer 42 divides brightness of the back light corresponding to gray levels of the brightness components into at least two regions, and generates the brightness control signal Dimming such that regions of the brightness are selected in correspondence with the control value.

Moreover, the picture quality enhancer 42 generates second vertical/horizontal synchronizing signals Vsync2 and Hsync2, a second clock signal DCLK2 and a second data enable signal DE2 synchronized with the second data Ro, Go and Bo with the aid of the first vertical/horizontal synchronizing signals Vsync1 and Hsync1, the first clock signal DCLK1 and the first data enable signal DE1 inputted from the system 40.

Figure 3:
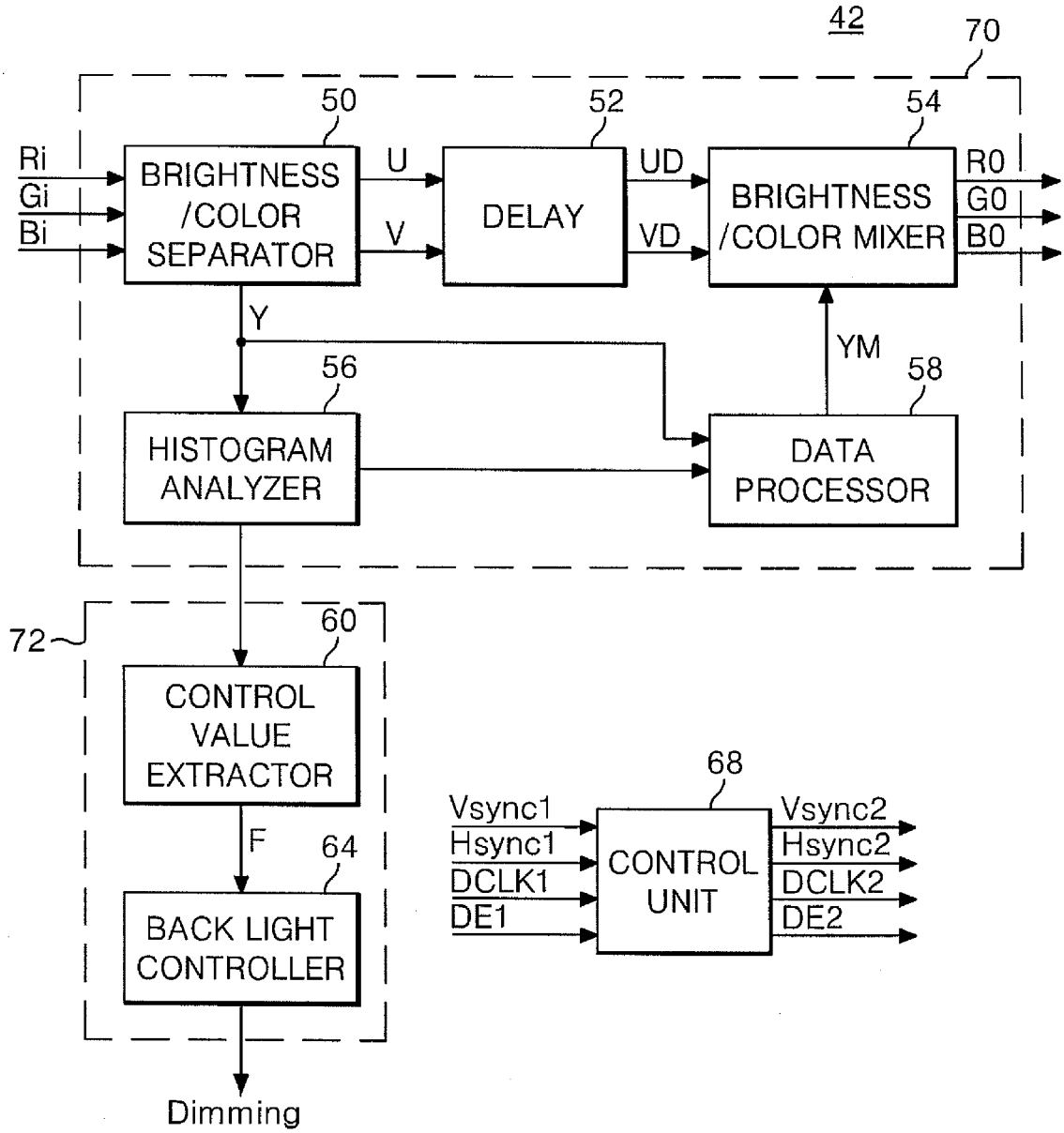
FIG. 3 is a block diagram of a first embodiment of the picture quality enhancer shown in FIG. 2.

To this end, as shown in FIG. 3, the picture quality enhancer 42 includes an image signal modulator 70 for generating the second data Ro, Go and Bo using the first data Ri, Gi and Bi, a back light control 72 for generating the brightness control signal Dimming under control of the image signal modulator 70, and a control unit 68 for generating the second vertical/horizontal synchronizing signals Vsync2 and Hsync2, the second clock signal DCLK2 and the second enable signal DE2.

The image signal modulator 70 extracts brightness components Y from the first data Ri, Gi and Bi, and generates second data Ro, Go and Bo in which the contrast is partially emphasized using the extracted brightness components Y. To this end, the image signal modulator 70 includes a brightness/color separator 50, a delay 52, a brightness/color mixer 54, a histogram analyzer 56 and a data processor 58.

The brightness/color separator 50 separates the first data Ri, Gi and Bi into brightness components Y and chrominance components U and V. The brightness components Y and the chrominance components U and V are obtained by the following equations:

$$Y=0.229\times Ri+0.587\times Gi+0.114\times Bi \quad (1)$$

$$U=0.493\times(Bi-Y) \quad (2)$$

$$V=0.887\times(Ri-Y) \quad (3)$$

Figure 4:
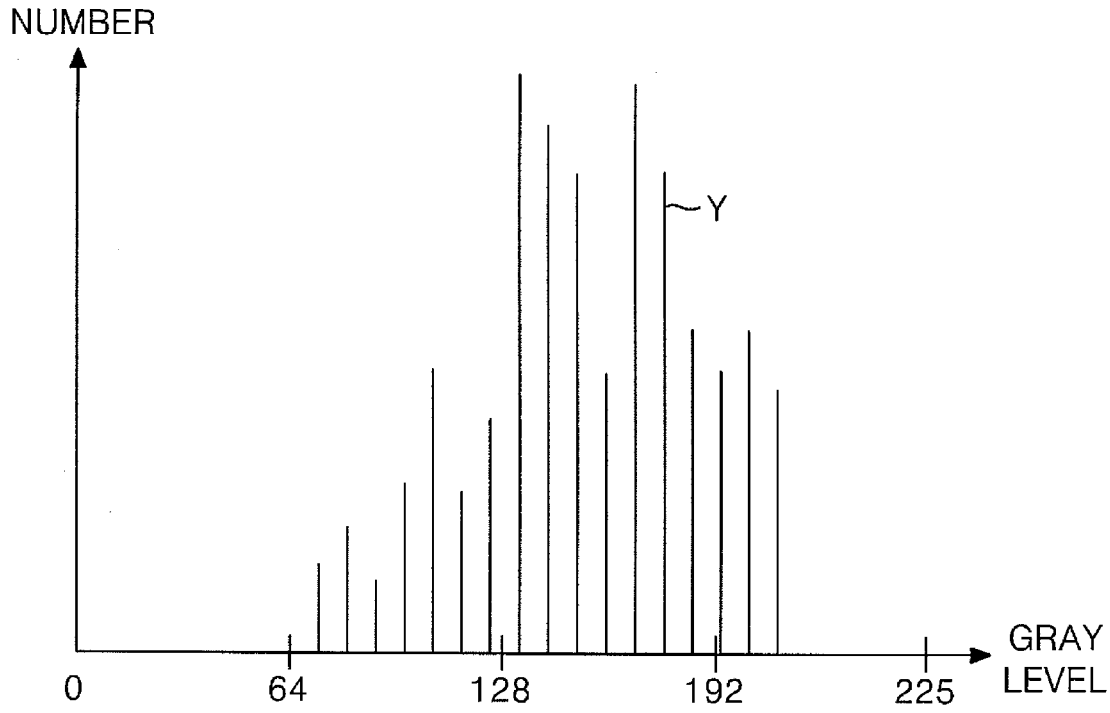
FIG. 4 is a graph showing an example of a histogram analyzed by the histogram analyzer shown in FIG. 3.

The histogram analyzer 56 divides the brightness components Y into gray levels for each frame. In other words, the histogram analyzer 56 arranges the brightness components Y for each frame to correspond to the gray levels, thereby obtaining a histogram as shown in FIG. 4. Thus, the shape of the histogram depends upon the brightness components of the first data Ri, Gi and Bi.

The data processor 58 generates modulated brightness components YM having a selectively emphasized contrast using the analyzed histogram from the histogram analyzer 56. The data processor 58 generates modulated brightness components YM by various methods. Schemes to expand the contrast disclosed in Korean Patent Applications Nos. 2003-036289, 2003-040127, 2003-041127, 2003-80177, 2003-81171, 2003-81172, 2003-81173 and 2003-81175, have been previously discussed by the present applicants and are all herein incorporated by reference in their entirety. The operation procedure of the data processor may be selected from methods disclosed in the above-mentioned applications or other known methods.

The delay 52 delays chrominance components U and V until the brightness components YM modulated by the data processor 58 are produced. The delay 52 delays the chrominance components U and V for one frame every frame to apply them to the brightness/color mixer 54.

More specifically, the histogram analyzer 56 divides the brightness components Y into gray levels of each frame to generate a histogram. Then, the data processor 58 generates modulated brightness components YM using the histogram. In other words, the histogram analyzer 56 generates a histogram for each frame using brightness components of the current frame, and the data processor 58 generates modulated brightness components YM using the histogram of the current frame (also referred to as the current histogram). Thus, the delay 52 delays the chrominance components U and V for more than at least one frame in consideration of the time (i.e., one frame) that it takes to generate a histogram corresponding to the current frame by the histogram analyzer 56 and the time it takes to generate the modulated brightness components YM.

The brightness/color mixer 54 generates second data Ro, Go and Bo with the aid of the modulated brightness components YM and the delayed chrominance components UD and VD. The second data Ro, Go and Bo is obtained by the following equations:

$$Ro=YM+0.000\times UD+1.140\times VD \quad (4)$$

$$Go=YM-0.396\times UD-0.581\times VD \quad (5)$$

$$Bo=YM+2.029\times UD+0.000\times VD \quad (6)$$

Since the second data Ro, Go and Bo obtained by the brightness/color mixer 54 has been produced from the modulated brightness components YM having an expanded contrast, they have more expanded contrast than the first data Ri, Gi and Bi. The second data Ro, Go and Bo produced such that the contrast can be expanded as mentioned above is applied to the timing controller 30.

The control unit 68 receives the first vertical/horizontal synchronizing signals Vsync1 and Hsync1, the first clock signal DCLK1 and the first data enable signal DE1 from the system 40. Further, the control unit 68 generates the second vertical/horizontal synchronizing signals Vsync2 and Hsync2, the second clock signal DCLK2 and the second data enable signal DE2 to be synchronized with the second data Ro, Go and Bo, and applies them to the timing controller 30.

The back light control 72 extracts a control value from the histogram analyzer 56, and generates a brightness control signal Dimming using the extracted control value. The control value allows brightness of the back light 38 to be changed, and can be set to different values. For instance, as above, the control value may be the most-frequent value and/or the average value.

The back light control 72 includes a control value extractor 60 and a back light controller 64.

Figure 5:
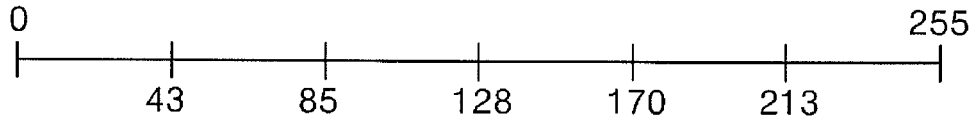
FIG. 5 depicts a brightness area for controlling brightness at the back light controller shown in FIG. 3.

As shown in FIG. 5, the back light controller 64 divides gray levels of the brightness components Y into a plurality of areas, and controls the back light 38 such that a different brightness of light can be supplied for each area. In other words, the back light controller 64 determines the gray level of the control value and generates a brightness control signal Dimming to correspond to an area to which the control value belongs.

The control value extractor 60 extracts a control value from the histogram analyzer 56 to apply it to the back light controller 64.

An operation procedure of the back light control 72 will be described in detail below.

First, the control value extractor 60 extracts a histogram analyzed by the histogram analyzer 56 to apply it to the back light controller 64. The back light controller 64 having received the control value checks an area (i.e., gray level value) to which a control value applied thereto belongs. In other words, the back light controller 64 checks an area to which the control value belongs of a plurality of divided gray level values as shown in FIG. 5, and generates a brightness control signal Dimming corresponding thereto.

The brightness control signal Dimming from the back light controller 64 is applied to the inverter 36. The inverter 36 controls the back light 38 in response to the brightness control signal Dimming, thereby applying a light corresponding to the brightness control signal Dimming to the liquid crystal display panel 22.

Accordingly, the present embodiment generates the second data Ro, Go and Bo having a contrast expanded in correspondence with the brightness components Y for one frame of the first data Ri, Gi and Bi inputted from the exterior thereof, thereby displaying a vivid image. Furthermore, the present invention controls brightness of the back light 38 in correspondence with the brightness components Y for one frame of the first data Ri, Gi and Bi, thereby displaying a vivid image.

Moreover, such an embodiment changes data of the current frame (the current data) using the histogram of the current frame (the current histogram). In order to change the current data using a result of the current frame, the input data (i.e., chrominance components) are delayed for each frame. In other words, in order to change the current data using a result of the current frame, the data are delayed during the time over which the current histogram is generated.

To this end, known methods include a frame memory for delaying the data of each frame. For instance, the delay 52 is comprised of a frame memory. However, a use of the frame memory causes the manufacturing cost to increase. Also, if the frame memory is used, then the picture quality enhancer 42 cannot be integrated. If the picture quality enhancer 42 is not an integrated component, considerable process time is wasted in mounting various parts of the picture quality enhancer 42 during fabrication.

Figure 6:
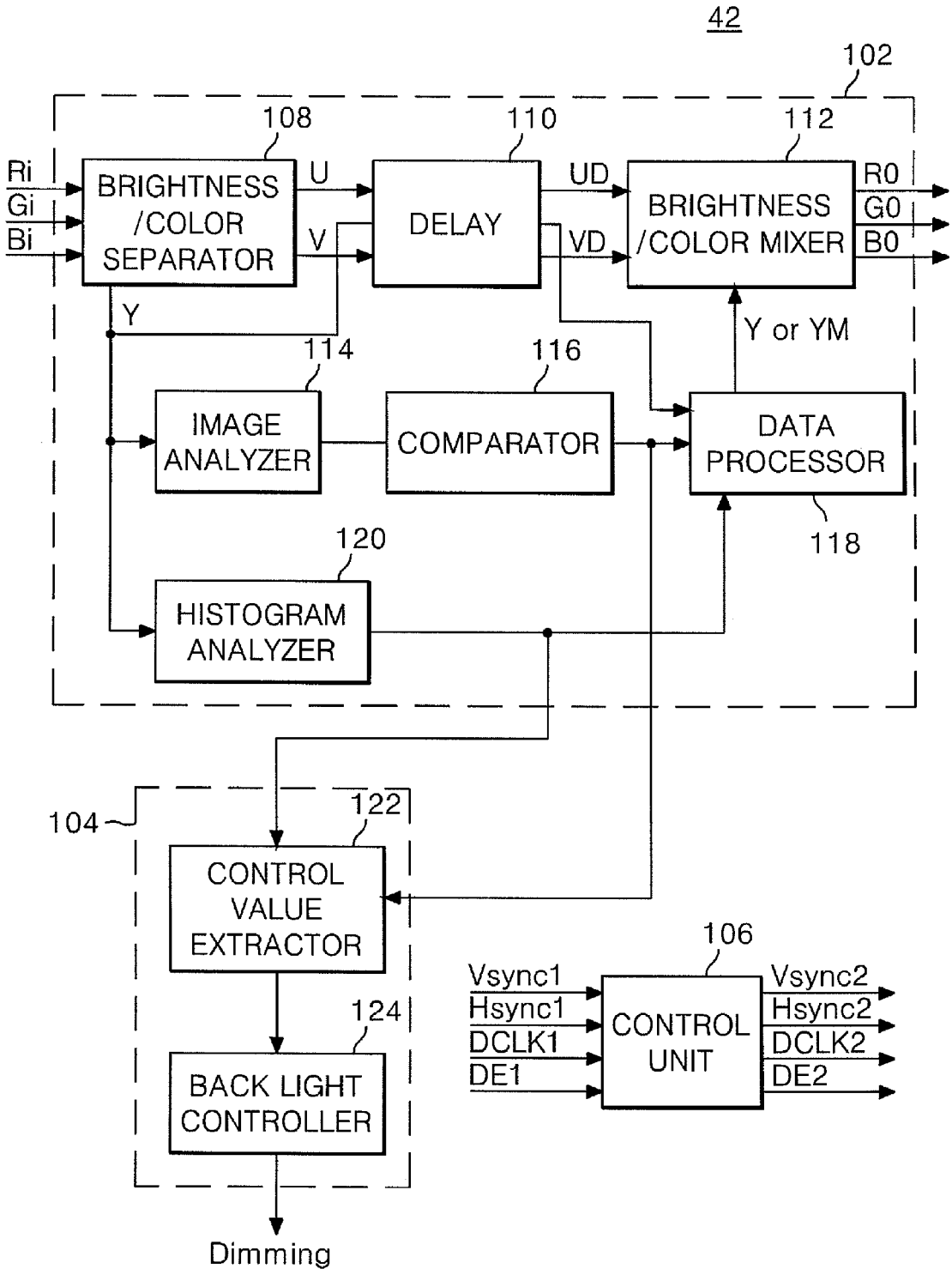
FIG. 6 is a block diagram of a second embodiment of the picture quality enhancer shown in FIG. 2.

In order to overcome such problems, a picture quality enhancer 42 according to another embodiment of the present invention is shown in FIG. 6.

Referring to FIG. 6, the picture quality enhancer 42 according to another embodiment of the present invention includes an image signal modulator 102 for changing current data using the previous histogram, a back light control 104 for generating the brightness control signal Dimming under control of the image signal modulator 102, and a control unit 106 for generating the second vertical/horizontal synchronizing signals Vsync2 and Hsync2, the second clock signal DCLK2 and the second enable signal DE2.

The image signal modulator 102 compares an image of the previous frame (the previous image) with an image of the current frame (the current image), and changes the current data using a result of the previous frame if the current image is analogous to the previous image.

To this end, the image signal modulator 102 includes a brightness/color separator 108, a delay 110, a brightness/color mixer 114, an image analyzer 114, a comparator 116, a data processor 118 and a histogram analyzer 120.

The brightness/color separator 108 separates the first data Ri, Gi and Bi into brightness components Y and chrominance components U and V by applying the above equations (1) to (3).

The histogram analyzer 120 divides the brightness components Y from the brightness/color separator 108 into gray levels for each frame to generate a histogram. Further, the histogram analyzer 120 applies the previous histogram to the data processor 118 and the control value extractor 122. In other words, in another embodiment of the present invention, the histogram analyzer 120 generates a histogram using brightness components Y for the ith frame (i.e., the current frame) and, at the same time, applies a histogram for (i−1)th frame (i.e., the previous frame) generated earlier to the data processor 118 and the control value extractor 122.

Figure 7:
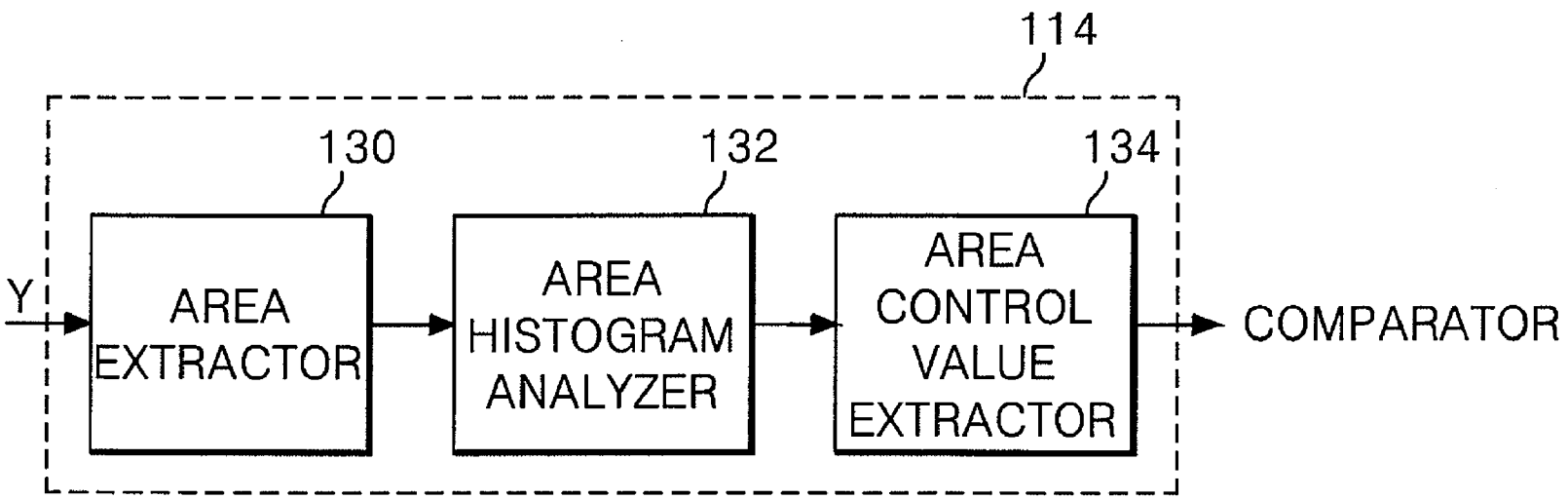
FIG. 7 is a detailed block diagram of the image analyzer shown in FIG. 6.

The image analyzer 114 extracts brightness components Y in a partial area, of brightness components Y of one frame applied thereto, and applies them to the comparator 116. To this end, the image analyzer 114 includes an area extractor 130, an area histogram analyzer 132 and an area control value extractor 134 as shown in FIG. 7.

Figure 8A:
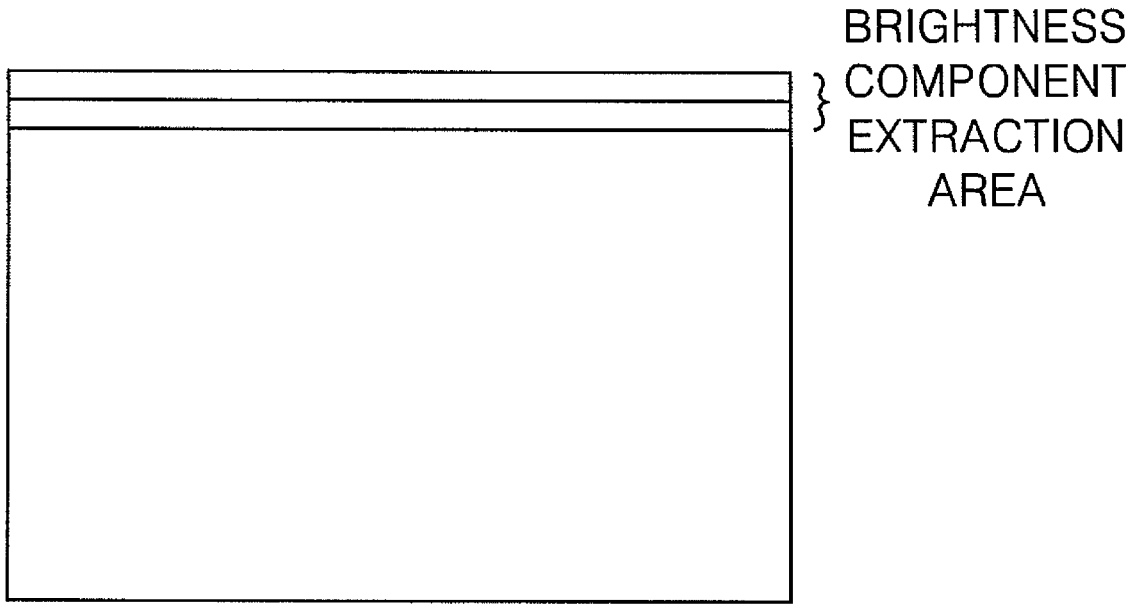
FIG. 8A to FIG. 8C depict areas selected by the area extractor shown in FIG. 7.
Figure 8B:
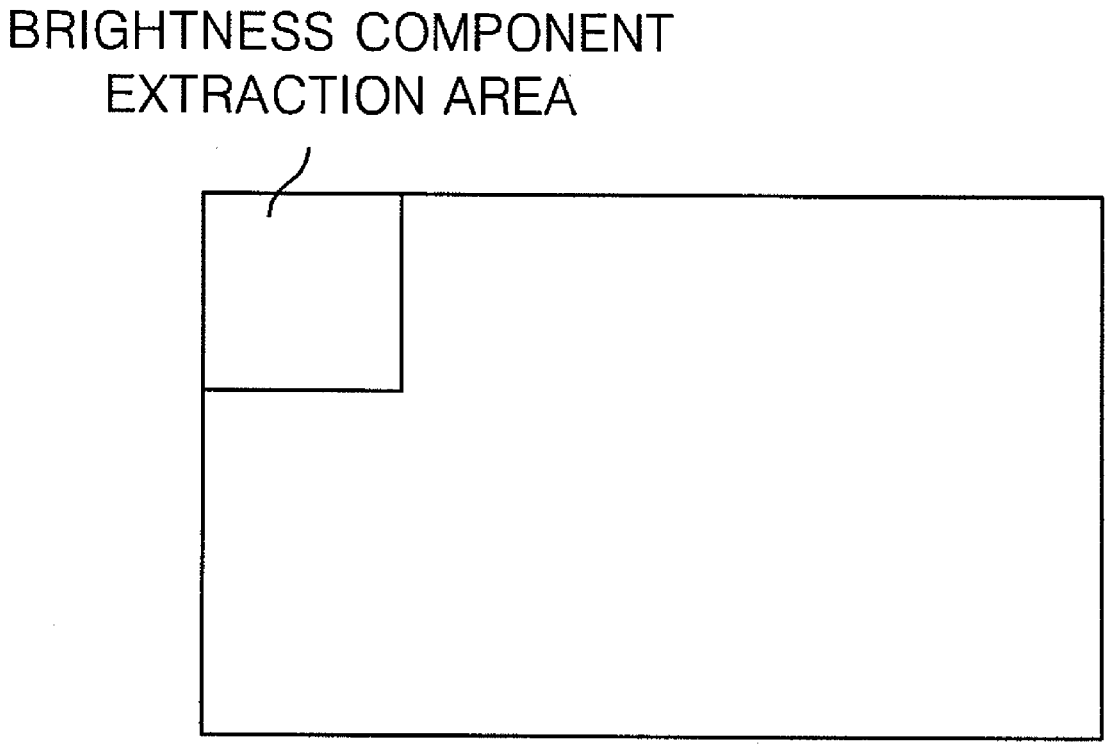
Figure 8C:
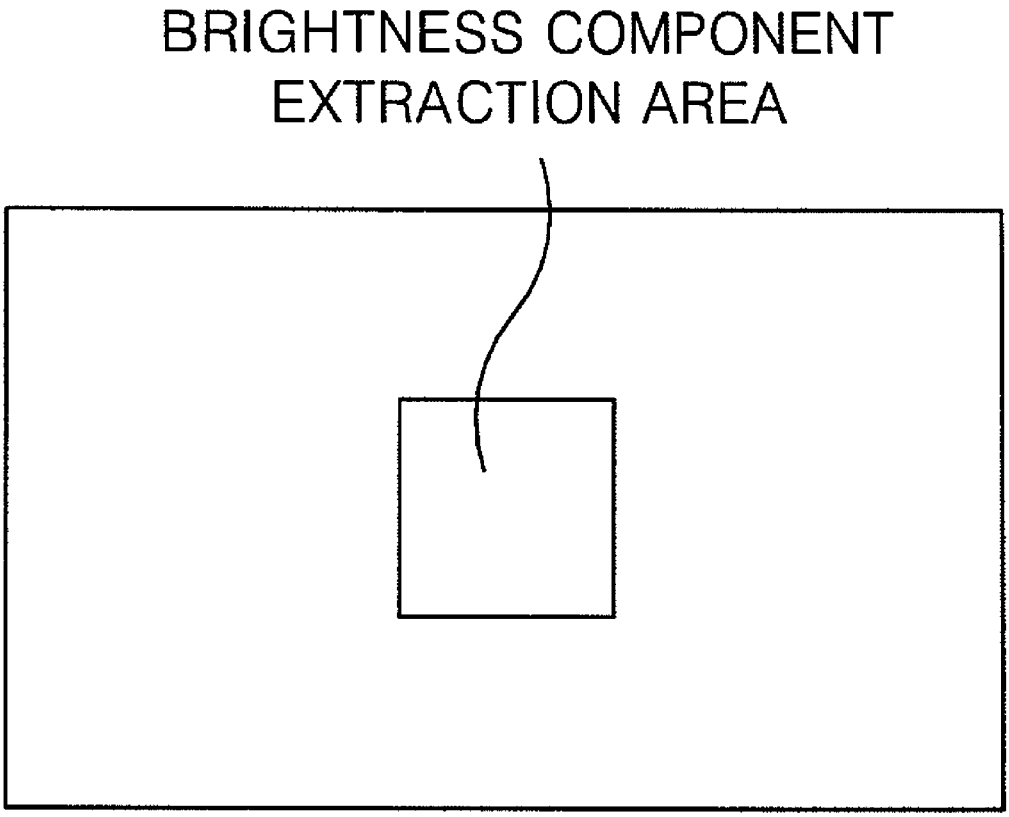

The image extractor 130 extracts brightness components Y in the partial area of brightness components Y of one frame. For instance, the area extractor 130 extracts only brightness components Y for first and second horizontal lines of brightness components for one frame as shown in FIG. 8A. Other examples of areas in which the brightness components Y are extracted by the image extractor 130 are shown in FIG. 8B and FIG. 8C.

Figure 9:
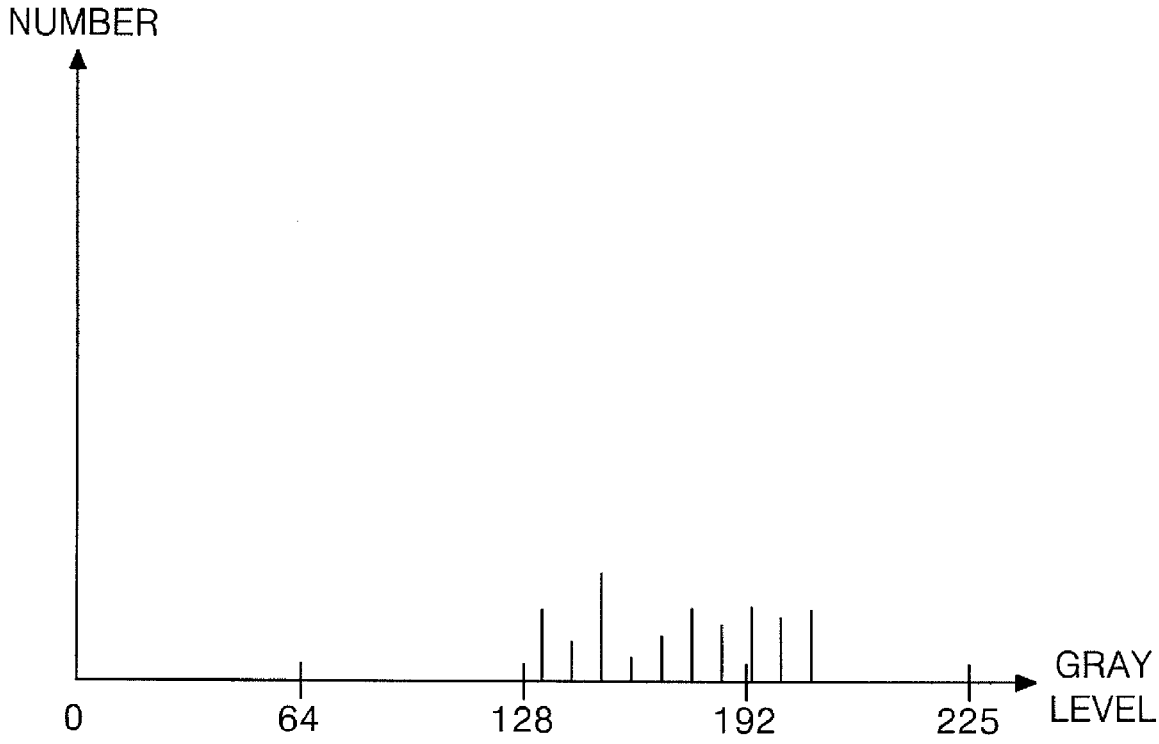
FIG. 9 is a graph showing an example of a histogram analyzed by the area histogram analyzer shown in FIG. 7.

The area histogram analyzer 132 divides brightness components Y in the partial area extracted by the area extractor 130 into gray levels to generate an area histogram. In other words, the area histogram analyzer 132 generates an area histogram using brightness components Y in the partial area as shown in FIG. 9.

The area control value extractor 134 extracts an area control value from the area histogram generated from the area histogram analyzer 132. The image control value may be the most-frequent value and/or the average value of the image histogram.

The comparator 116 compares the current area control value applied from the image analyzer 114 with the previous area control value stored therein to thereby determine the difference between the current and previous images.

Figure 10:
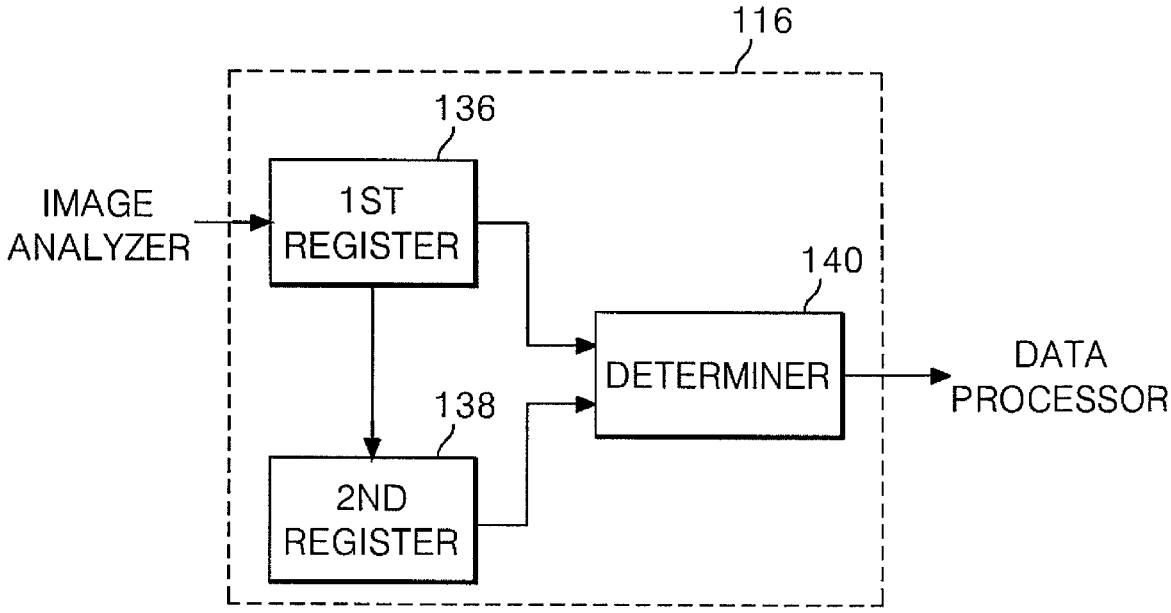
FIG. 10 is a detailed block diagram of the comparator shown in FIG. 6.

To this end, the comparator 116 includes a first register 136, a second register 138 and a determiner 140 as shown in FIG. 10.

The current area control value applied from the image analyzer 114 is stored in the first register 136. The previous area control value applied from the first register is stored in the second register 138.

The determiner 140 compares the current area control value applied from the first and second registers 136 and 138 with the previous area control value to thereby determine the difference between the current and previous images. The determiner 140 determines that the current image is analogous to the previous image when the current area control value is equal to the previous area control value. Also, the determiner 140 determines that the current image is analogous to the previous image when the current area control value is within a specific deviation the previous area control value. The specific deviation is experimentally determined such that images between frames can be determined analogously with respect to each other.

Figure 11A:
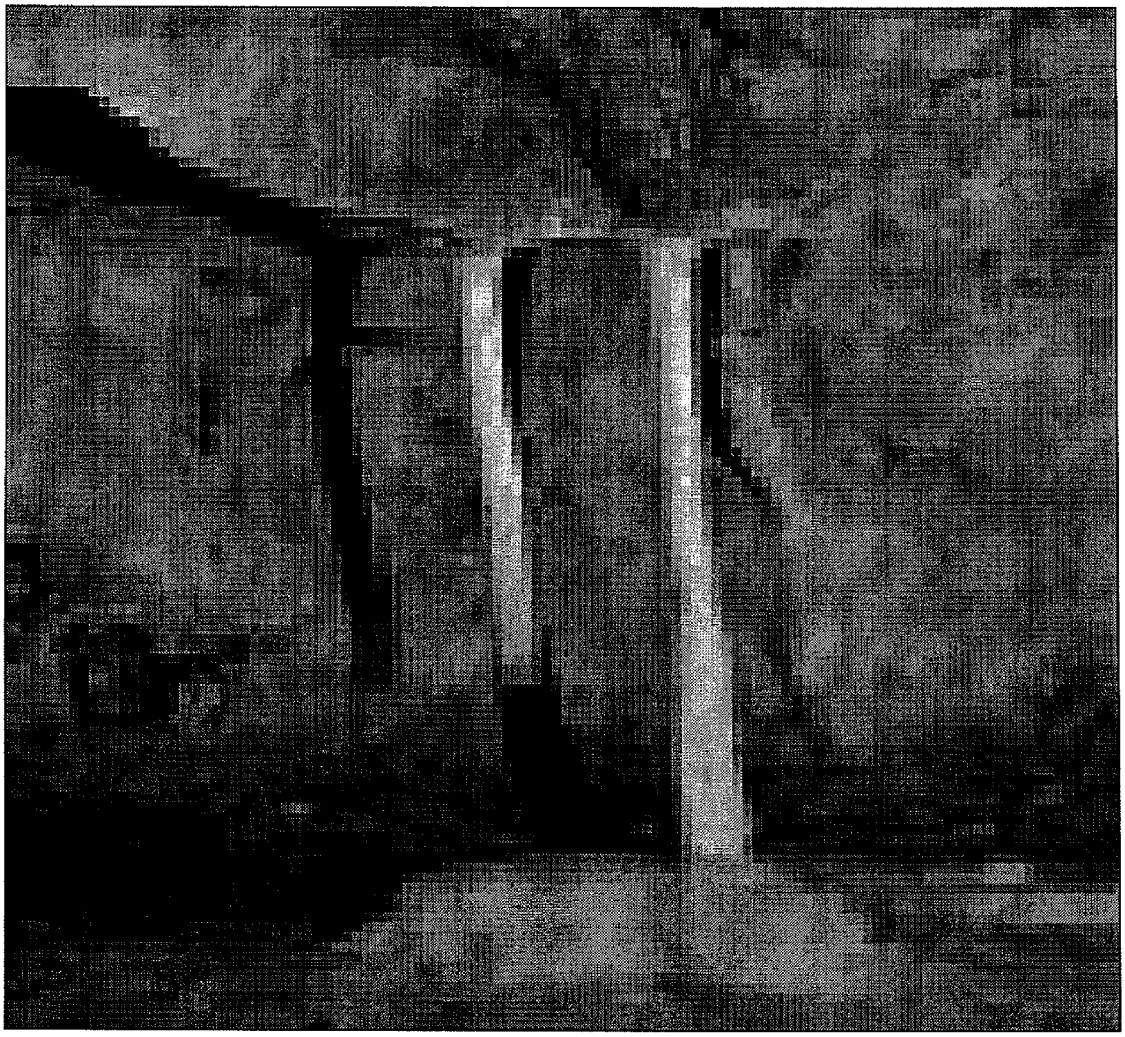
FIG. 11A to FIG. 11C shows images displayed during a specific frame.
Figure 11B:
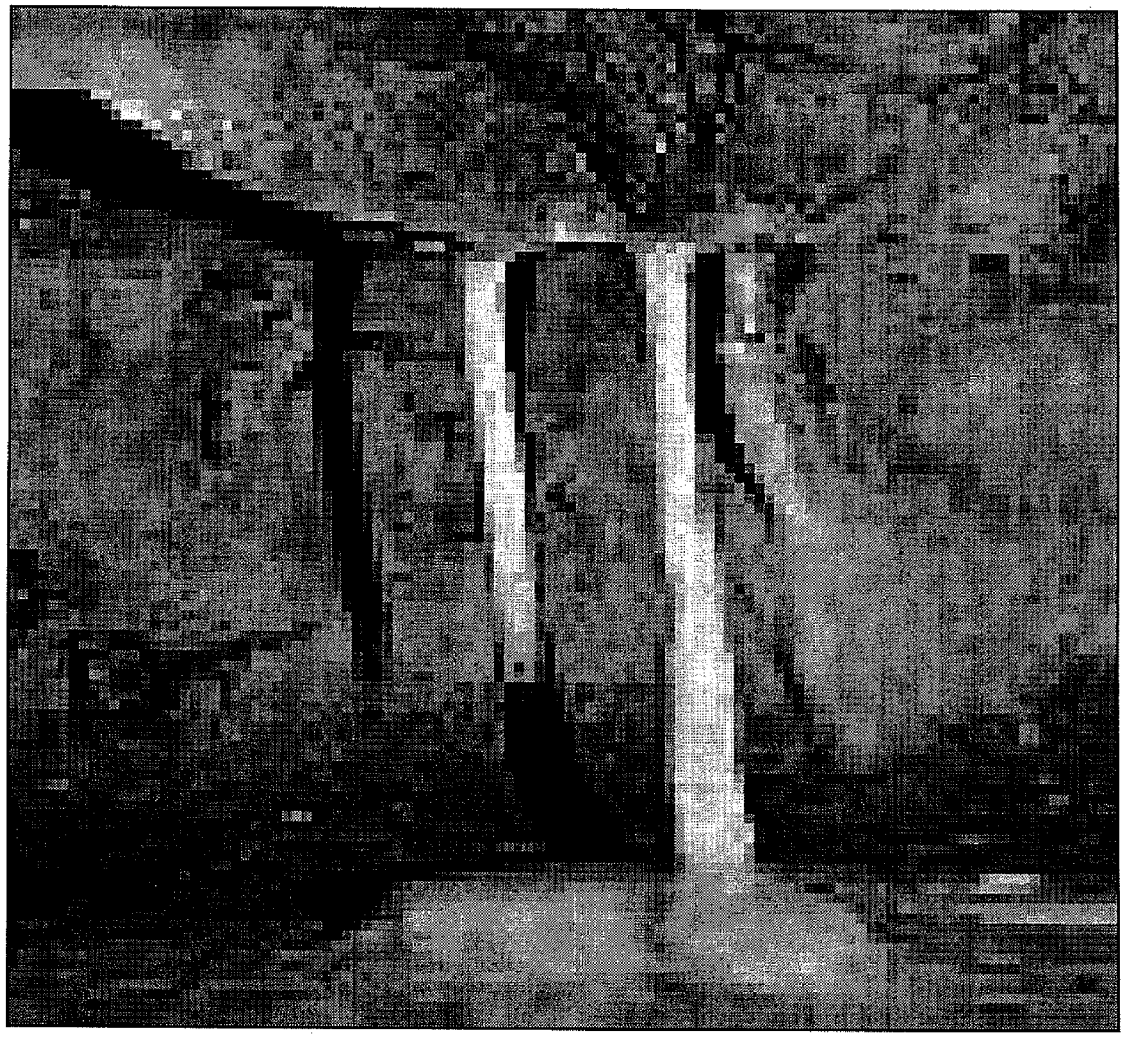
Figure 11C:
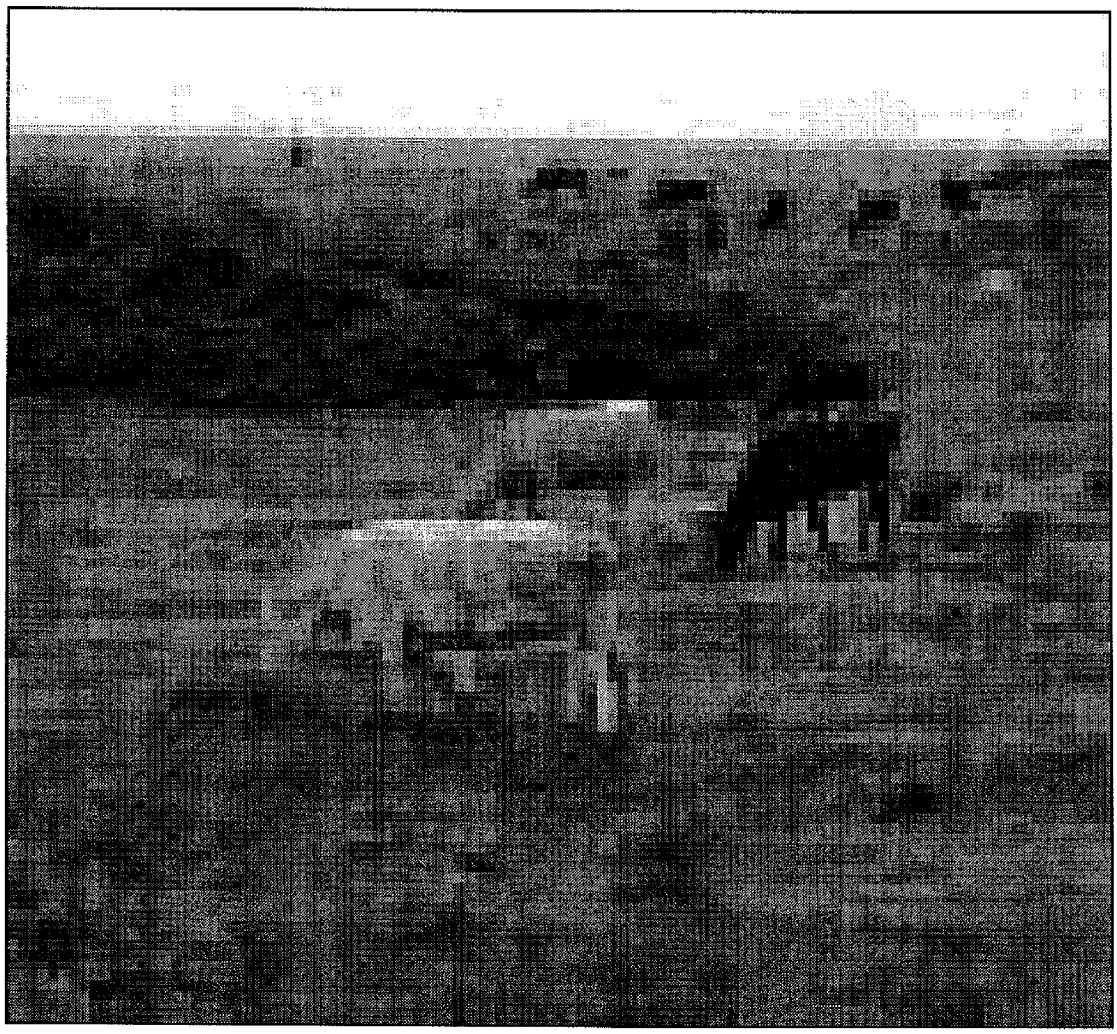

FIGS. 11A and 11B illustrate an example of consecutive frames that are analogous, that is, in which the area control value differs by less than a particular deviation. On the other hand, FIGS. 11A and 11C illustrate an example of consecutive frames that are not analogous, that is, in which the area control value differs by greater than the particular deviation.

If the comparator 116 determines that the previous image is analogous to the current image, then the data processor 118 generates modulated brightness components YM having a selectively emphasized contrast using the previous histogram from the histogram analyzer 120 and applies the modulated brightness components YM to the brightness/color mixer 112. On the other hand, if the comparator 116 determines that the previous image is different from the current image, then the data processor 118 applies current brightness components from the delay 110 to the brightness/color mixer 112.

Figure 12:
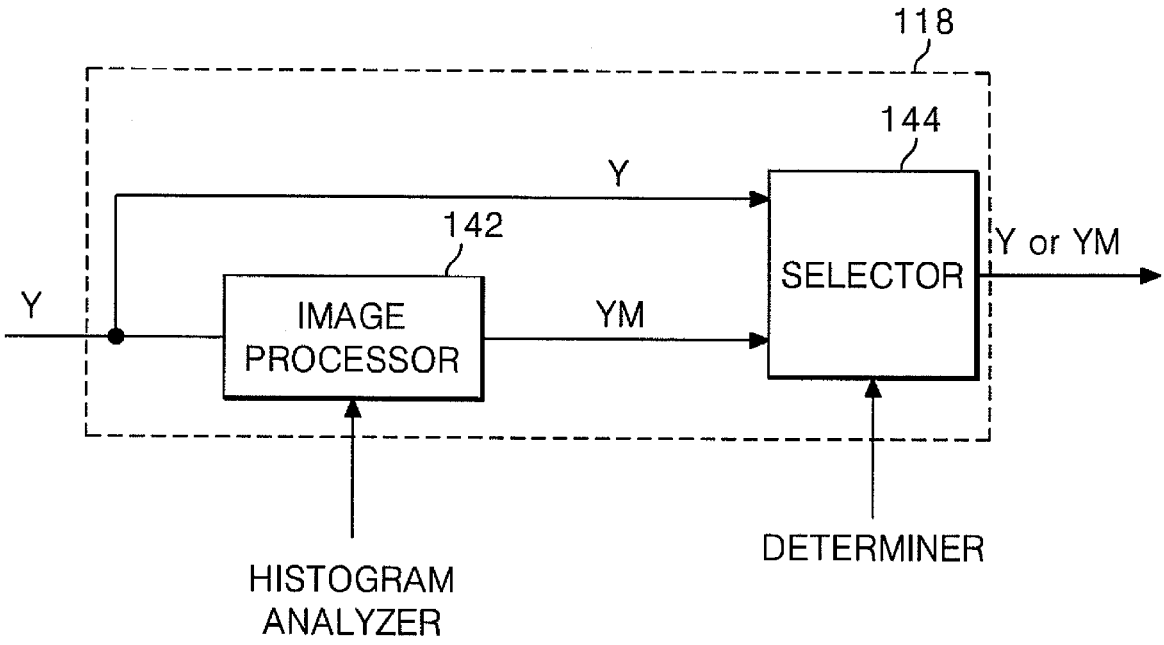
FIG. 12 is a detailed block diagram of the data processor shown in FIG. 6.

To this end, the data processor 118 includes an image processor 142 and a selector 144 as shown in FIG. 12. The image processor 142 receives current brightness components Y from the delay 110 and, at the same time, receives the previous histogram from the histogram analyzer 120. The image processor 142 having received the previous histogram changes the current brightness components Y to generate modulated brightness components YM having a selectively emphasized contrast.

The selector 144 receives the current brightness components Y from the delay 110 and, at the same time, receives modulated brightness components YM from the image processor 142. The selector 144 receives a control signal from the determiner 140.

When a first control signal is applied from the determiner 140 (i.e., when it is determined that the current image is analogous to the previous image), the selector 144 applies the modulated brightness components YM applied thereto to the brightness/color mixer 112. Otherwise, when a second control signal is applied from the determiner 140 (i.e., when it is determined that the current image is different from the previous image), the selector 144 applies the brightness components Y applied thereto to the brightness/color mixer 112.

The delay 110 delays chrominance components U and V and brightness components Y from the brightness/color separator 108 by a desired time. In one embodiment, this time is the time it takes the image analyzer 114 to compare the previous image with the current image. For instance, if the image analyzer 114 determines an analogy exists between the previous image and the current image using only brightness components Y for two horizontal lines as shown in FIG. 8A, then the delay 110 delays the chrominance components U and V and the brightness components Y by the time corresponding to two horizontal lines. In other words, in another embodiment of the present invention, the delay 110 is comprised of internal shift buffers, etc. corresponding to a certain line because it delays the chrominance components U and V and the brightness components Y by the time corresponding to a certain area. By using internal shift buffers, or a similar method, rather than a frame memory, the overall arrangement can be easily integrated.

The brightness/color mixer 112 generates the second data Ro, Go and Bo (i.e., data of the current frame) using brightness components Y or modulated brightness components YM from the data processor 118 or chrominance components UD and VD from the delay 110. If the current image is analogous to the previous image, then the second data Ro, Go and Bo have more expanded contrast than the first data Ri, Gi and Bi. In other words, if the current image is analogous to the previous image, then the second data Ro, Go and Bo is generated using the modulated brightness components YM. On the other hand, if the current image is different from the previous image, then the second data Ro, Go and Bo have the same contrast ratio as the first data Ri, Gi and Bi. In this cse, the first data and the second data are identical to each other and the second data Ro, Go and Bo are produced using the brightness components Y.

An operation procedure of such an image signal modulator 102 will be described below.

First, the brightness/color separator 108 separates the first data Ri, Gi and Bi into brightness components Y and chrominance components U and V. The brightness components Y are applied to the image analyzer 114 and the histogram analyzer 120. In addition, the brightness components Y and the chrominance components U and V are applied to the delay 110 and are delayed by a desired time.

The histogram analyzer 120 having received the current brightness components Y divides the current brightness components Y into gray levels to generate a histogram and, at the same time, applies the previous histogram to the control value extractor 122 and the data processor 118. The image analyzer 114 and the comparator 116 having received the current brightness components Y compares a partial area of the current frame with a partial area of the previous frame, thereby determining an analogy between the current image and the previous image.

If the comparator 116 determines that the current image is analogous to the previous image, then the data processor 118 changes the brightness components Y from the delay 110 to have an expanded contrast using the previous histogram to generate modulated brightness components YM, and applies the modulated brightness components YM to the brightness/color mixer 112. On the other hand, if the comparator 116 determines that the current image is different from the previous image, then the data processor 118 applies the brightness components Y from the delay 110 to the brightness/color mixer 112 as they are. The brightness/color mixer 112 generates the second data Ro, Go and Bo using the brightness components Y or the modulated brightness components YM to apply them to the timing controller 30.

The image signal modulator 102 according to another embodiment of the present invention determines an analogy between the previous image and the current image. If it is determined that the previous image is analogous to the current image, the image signal modulator 102 changes current data to have an expanded contrast using the previous brightness component histogram. Accordingly, in another embodiment of the present invention, a frame memory is not used because a data is not delayed for each frame. Thus the picture quality enhancer 42 can be easily integrated.

The control unit 106 receives the first vertical/horizontal synchronizing signals Vsync1 and Hsync1, the first clock signal DCLK1 and the first data enable signal DE1 from the system 40. Further, the control unit 106 generates the second vertical/horizontal synchronizing signals Vsync2 and Hsync2, the second clock signal DCLK2 and the second data enable signal DE2 in such a manner to be synchronized with the second data Ro, Go and Bo, and applies them to the timing controller 30.

The back light control 104 receives a histogram of the previous frame from the histogram analyzer 120. In this case, the back light control 104 determines whether or not the control value has been extracted in response to the control signal from the comparator 116. If the control value has been extracted, then the back light control 104 generates a brightness control signal Dimming using the extracted control value. Otherwise, if the control value has not been extracted, then the back light control 104 generates a brightness control signal Dimming such that light having a predetermined brightness can be generated.

To this end, the back light control 104 includes a control value extractor 122 and a back light controller 124.

The control value extractor 122 receives a first control signal (for determining that the current image is analogous to the previous image) or a second control signal (for determining that the current image is different from the previous image) from the comparator 116. Further, the control value extractor 122 receives the previous histogram from the histogram analyzer 120.

If the first control signal is inputted from the comparator 116, then the control value extractor 122 extracts the previous control value to apply it to the back light controller 124. The back light controller 124 generates a brightness control signal Dimming such that light having brightness corresponding to the control value applied thereto can be applied to the liquid crystal display panel, and applies it to the inverter 36.

On the other hand, if the second control signal is inputted from the comparator 116, then the control value extractor 122 does not extract the previous control value. Thus, the control value is not applied to the back light controller 124. The back light controller 124 having not received the control value generates a brightness control signal Dimming such that light having a predetermined brightness (e.g. medium brightness) can be applied to the liquid crystal display panel 22, and applies it to the inverter 36. The predetermined brightness is set to be equal to the brightness of the conventional back light applied to the liquid crystal display panel 22 irrespective of the data.

Figure 13:
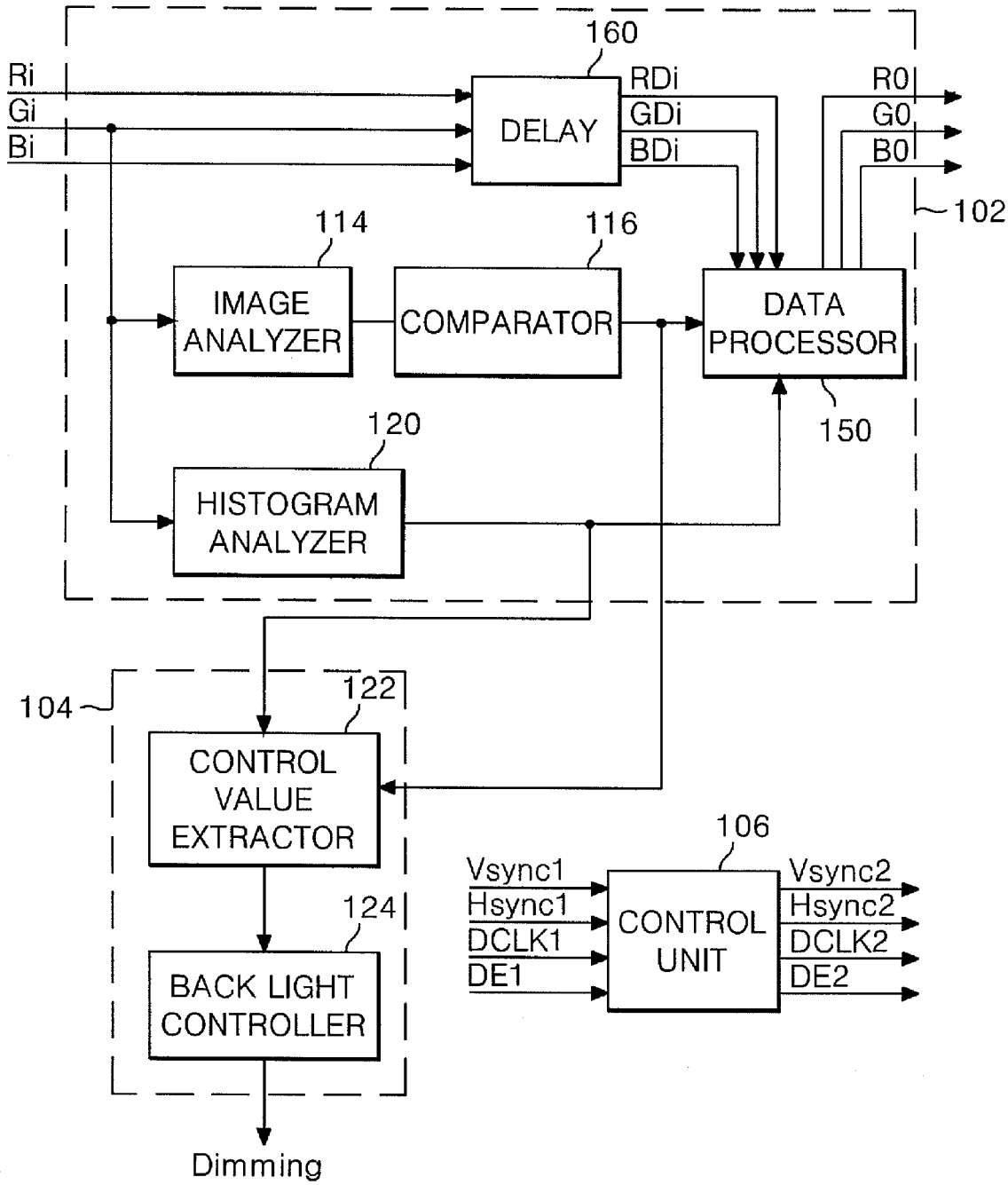
FIG. 13 is a block diagram of a third embodiment of the picture quality enhancer shown in FIG. 2.

Alternatively, as shown in FIG. 13, the present invention may determine the current brightness using the first green data Gi of the first data Ri, Gi and Bi, and generates the second data Ro, Go and Bo dependent upon the determined brightness. For instance, approximately 60% of the entire brightness components Y are determined by green data G as indicated in the above equation (1). In other words, generally brightness of the liquid crystal display panel is determined by green data. More specifically, only images of pure red (R), blue (B) and magenta series (which do not require a brightness picture) are images that do not use green data G.

Accordingly, in still another embodiment of the present invention, brightness can be determined using the green data G as shown in FIG. 13. Elements in FIG. 13 similar to those in FIG. 6 will be assigned to the same reference numerals, and a detailed explanation as to them will be omitted. For instance, an explanation of the back light control 104 and the control unit 106 will be omitted.

In still another embodiment of the present invention, an image signal modulator 102 includes a delay 110, an image analyzer 114, a comparator 116, a histogram analyzer 120 and a data processor 150. In other words, the image signal modulator 102 according to still another embodiment of the present invention determines brightness using the green data G; the brightness/color separator 108 and the brightness/color mixer 112 shown in FIG. 6 are eliminated.

The histogram analyzer 120 divides green data Gi for the current frame into gray levels for each frame to generate a histogram, and applies the previous histogram to the control value extractor 122 and the data processor 150.

The image analyzer 114 and the comparator 116 compares a partial area of the current frame with a partial area of the previous frame using the green data to thereby determine the analogy between the current image and the previous image.

If the comparator 116 determines that the previous image is analogous to the current image, then the data processor 150 changes the data Ri, Gi and Bi from the delay 110 to have an expanded contrast using the previous histogram to thereby generate the second data Ro, Go and Bo. On the other hand, if the comparator 116 determines that the previous image is different from the current image, then the data processor 150 outputs the data Ri, Gi and Bi from the delay 110 without any change.

Figure 14:
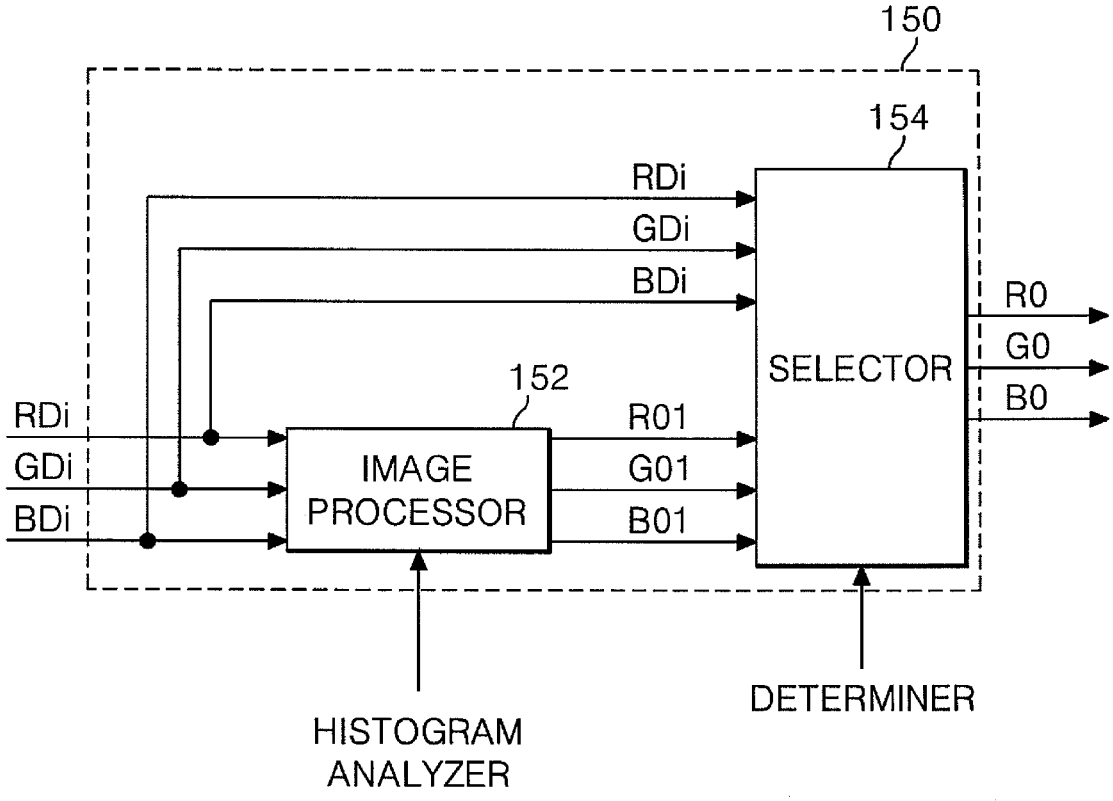
FIG. 14 is a detailed block diagram of the data processor shown in FIG. 13.

To this end, the data processor 150 includes an image processor 152 and a selector 154 as shown in FIG. 14. The image processor 152 receives the first data RDi, GDi and BDi from the delay 110 and, at the same time, receives the previous histogram from the histogram analyzer 120. The image processor 152 having received the previous histogram generates output data RO1, GO1 and BO1 having an emphasized contrast using the previous histogram.

The selector 144 receives the first data RDi, GDi and BDi from the delay 110 and, at the same time, receives the output data RO1, GO1 and B01 from the image processor 152. The selector 154 receives a control signal from the comparator 116.

When a first control signal (for determining that the current image is analogous to the previous image) is applied from the comparator 116, the selector 154 applies the output data R01, GO1 and B01 supplied thereto to the timing controller 30. Herein, RO1=R1, GO1=GO, and B01=BO. On the other hand, when a second control signal (for determining that the current image is different from the previous image) is applied from the comparator 116, the selector 154 applies the first data RDi, GDi and BDi supplied thereto to the timing controller 30. Herein, RDi=RO, GDi=GO, and BDi=BO.

The image signal modulator 102 according to still another embodiment of the present invention determines the analogy between the previous image and the current image. If it is determined that the previous image is analogous to the current image, the image signal modulator 102 changes data of the current frame to have an expanded contrast using the previous brightness component histogram. Accordingly, in still another embodiment of the present invention, a frame memory is not used because the data is not delayed for each frame. Thus the picture quality enhancer 42 can be easily integrated. Furthermore, in still another embodiment of the present invention, brightness is determined using the green data, so that the process of converting data into brightness components and vice-versa can be eliminated.

As described above, according to the present invention, brightness of the current frame is controlled to have an expanded contrast when the previous image is analogous to the current image, so that it is possible to display a vivid image. Furthermore, according to the present invention, analogy between the images is determined by comparing the previous image with the current image. If it is determined that the previous image is analogous to the current image, data of the current frame is changed using the previous histogram. Accordingly, data of the current frame is changed using a result of the previous frame, so that a frame memory is not used and thus the manufacturing cost can be reduced. Moreover, a frame memory is not used, so that it becomes possible to easily integrate the picture quality enhancer.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus for a liquid crystal display, comprising:

an image signal modulator for expanding contrast of input data when a previous image is analogous to a current image to thereby generate output data; and a timing controller for re-arranging the output data to apply the output data to a data driver;

wherein the image signal modulator includes:

1) a histogram analyzer for arranging green data of the input data corresponding to the current frame into gray levels for each frame to generate a histogram and for storing the generated histogram using green data of data of the previous frame;

2) an image analyzer for extracting a control value from green data of a partial area of the green data of the current frame;

3) a comparator for determining an analogy between the current image and the previous image using a current partial area control value and a previous partial area control value; and 4) a data processor for generating the output data obtained by an expansion in a contrast of the input data in correspondence with a result of the comparator.

2. The driving apparatus of claim 1, wherein the data processor includes:

an image processor for generating the output data having an expanded contrast; and a selector for applying the output data or the input data to the timing controller.

3. The driving apparatus of claim 2, wherein the selector applies the output data to the timing controller when the comparator determines that the current image is analogous to the previous image, and the selector applies the input data to the timing controller when the comparator determines that the current image is not analogous to the previous image.

4. The driving apparatus of claim 1, further comprising:

delay means for delaying the input data during a time interval when the comparator determines the analogy between the current image and the previous image.

5. The driving apparatus of claim 1, further comprising:

back light control means for controlling brightness of a back light in response to a result of the comparator.

6. The driving apparatus of claim 5, wherein the back light control means includes:

a control value extractor for extracting a control value for a previous histogram when the comparator determines that the current image is analogous to the previous image; and a back light controller for controlling the brightness of the back light in correspondence with the extracted control value from the control value extractor.

7. The driving apparatus of claim 6, wherein the control value extractor does not extract the control value when the comparator determines that the current image is analogous to the previous image, and the back light controller controls the back light such that light of a predetermined brightness can be supplied when the control value is not applied from the control value extractor.

8. A method of driving a liquid crystal display, comprising:

determining an analogy between a previous image and a current image; and converting current input data to have an expanded contrast using a result of a previous frame when the previous image is analogous to the current image;

wherein determining the analogy includes:

1) arranging green data in a partial area of data for one frame into a histogram corresponding to gray levels;

2) extracting a control value from the histogram; and 3) determining that the previous image is analogous to the current image when the extracted control value is within a specific deviation from a control value extracted from the previous frame.

9. The method of claim 8, wherein converting the current input data includes:

converting the current input data using a histogram generated from green data of the previous frame.

* * * * *